US008947108B2

(12) United States Patent
Hodge

(10) Patent No.: US 8,947,108 B2
(45) Date of Patent: Feb. 3, 2015

(54) PRECISION TARGET METHODS AND APPARATUS

(71) Applicant: Bruce Hodge, Greenfield, NY (US)

(72) Inventor: Bruce Hodge, Greenfield, NY (US)

( * ) Notice: Subject to any disclaimer, the term of this patent is extended or adjusted under 35 U.S.C. 154(b) by 0 days.

(21) Appl. No.: 13/775,277

(22) Filed: Feb. 25, 2013

(65) Prior Publication Data

US 2014/0091816 A1 Apr. 3, 2014

Related U.S. Application Data

(60) Provisional application No. 61/603,084, filed on Feb. 24, 2012.

(51) Int. Cl.
*G01R 27/26* (2006.01)
*F41J 5/048* (2006.01)

(52) U.S. Cl.
CPC ..... *F41J 5/048* (2013.01)
USPC ..... 324/679; 324/750.24; 324/754.03; 273/348.1; 273/339; 273/403

(58) Field of Classification Search
USPC ..... 324/600, 679, 500, 750.24, 754.03, 324/754.1, 754.11, 754.21, 750.16, 717; 702/57, 176, 189, 104, 108, 116, 124, 702/127, 150; 273/348.1, 378–410
See application file for complete search history.

(56) References Cited

U.S. PATENT DOCUMENTS

| | | | |
|---|---|---|---|
| 474,109 | A | 5/1892 | Vogel |
| 2,108,919 | A | 2/1938 | Grigoriu |
| 2,784,001 | A | 3/1957 | Simjian |
| 2,934,346 | A | 4/1960 | Mongello |
| 3,585,497 | A | 6/1971 | Dalzell, Jr. |
| 3,727,069 | A | 4/1973 | Crittenden, Jr. et al. |
| 4,900,972 | A | 2/1990 | Wersing et al. |
| 4,914,565 | A | 4/1990 | Schnoeller et al. |
| 5,419,565 | A | 5/1995 | Gordon et al. |
| 5,516,113 | A | 5/1996 | Hodge |
| 5,988,645 | A | 11/1999 | Downing |

(Continued)

FOREIGN PATENT DOCUMENTS

| | | |
|---|---|---|
| GB | 19950 | 0/1910 |
| GB | 26257 | 0/1911 |
| WO | 0240756 A2 | 5/2002 |

OTHER PUBLICATIONS

European Search Report, dated Jul. 4, 2011, for corresponding EP Application No. 05810518.0, completed on Jun. 27, 2011.

*Primary Examiner* — Melissa Koval
*Assistant Examiner* — Trung Nguyen
(74) *Attorney, Agent, or Firm* — Heslin Rothenberg Farley & Mesiti P.C.; Nicholas Mesiti, Esq.; Victor A. Cardona, Esq.

(57) ABSTRACT

A method for determining and retrieving positional information includes forming a grid by locating a plurality of first conductive elements on a surface and a plurality of second conductive elements on the surface. A second grid is coupled to the surface and electrically isolated from the grid. The surface is penetrated with a projectile and a first location of a first penetration of the surface is electronically determined based on a first change in a first electrical measurement. A plurality of third and fourth electrical measurements are performed in a second plurality of locations of the second grid and the location impact is electronically determined.

4 Claims, 10 Drawing Sheets

(56) References Cited

U.S. PATENT DOCUMENTS

| | | | | |
|---|---|---|---|---|
| 6,133,989 | A | 10/2000 | Stettner et al. | |
| 6,414,746 | B1 | 7/2002 | Stettner et al. | |
| 6,604,946 | B2 | 8/2003 | Oakes | |
| 7,207,566 | B2 | 4/2007 | Hodge | |
| 7,862,045 | B2 * | 1/2011 | Hodge | 273/371 |
| 8,710,854 | B2 * | 4/2014 | Burberry et al. | 324/686 |
| 2009/0259409 | A1 | 10/2009 | O'Lenick, Jr. | |
| 2011/0214499 | A1 | 9/2011 | Hodge | |

* cited by examiner

PRECISION TARGET METHODS AND APPARATUS

CROSS REFERENCE TO RELATED APPLICATIONS

This application claims priority to U.S. Provisional patent application No. 61/603,984 filed on Feb. 24, 2012. This application also contains subject matter which is related to the subject matter of the following co-owned U.S. Patents and Applications. Each of the below listed applications is hereby incorporated herein by reference in its entirety:

U.S. Ser. No. 12/966,579, filed on Dec. 13, 2010;

U.S. Ser. No. 12/157,730, filed on Feb. 24, 2012;

U.S. Pat. No. 5,516,113, U.S. Pat. No. 7,207,566, and U.S. Pat. No. 7,862,045, the entire contents of which are incorporated herein by referenced.

COPYRIGHT NOTICE

A portion of the disclosure of this patent document contains material which is subject to copyright protection. The copyright owner has no objection to facsimile reproduction by anyone of the patent document or the patent disclosure, as it appears in the Patent & Trademark Office patent file or records, but otherwise reserves all copyright rights whatsoever.

TECHNICAL FIELD

The present application relates to methods and apparatus for target systems that can detect impact location with a high degree of accuracy using short circuit technology combined with multiple layered conductive plates orientated at different angles.

DETAILED DESCRIPTION

In 1892 Carl Vogel was awarded U.S. Pat. No. 474,109 Self Marking and Indicating Target. In that patent he describes a short circuit target that uses 2 conductive plates insulated by a non-conducting medium spaced in such a way that a bullet passing through the target will, for a moment in time, create a short between the 2 plates. By applying a voltage potential across those plates a short caused by a bullet passing through can be easily be detected.

U.S. Pat. Nos. 6,133,989 & 6,414,746 describe a 3D laser sensing system that can detect objects using a diffused pulsed laser beam and an optic sensor. The current embodiment of the ground disturbance locator is based on this technology.

Figure 1:
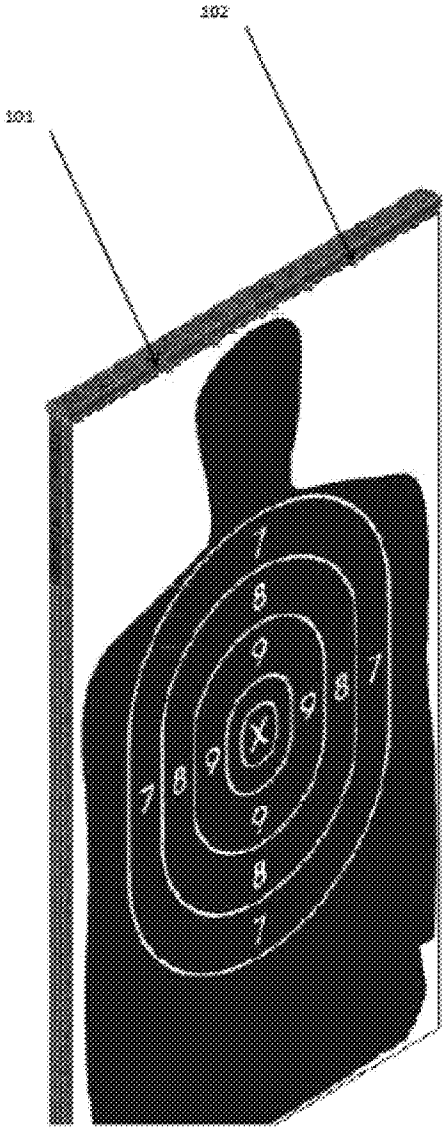

FIG. 1 shows a multi-layer target made from foil/conductive ink and cardboard/heavy paper or any non-electrically conductive material. The LED's on top of the target indicate either ring number (7, 8, 9, 10, Bull's-eye) or level of lethality. For example if first LED 101 momentarily lights up after the shot has been detected it could indicate that ring 7 had been hit or that the shot lethality was considered non-lethal (low) where as if the last LED 102 momentarily lit up that would indicate that the bull's-eye had been hit or a lethal shot had been detected.

Figure 2:
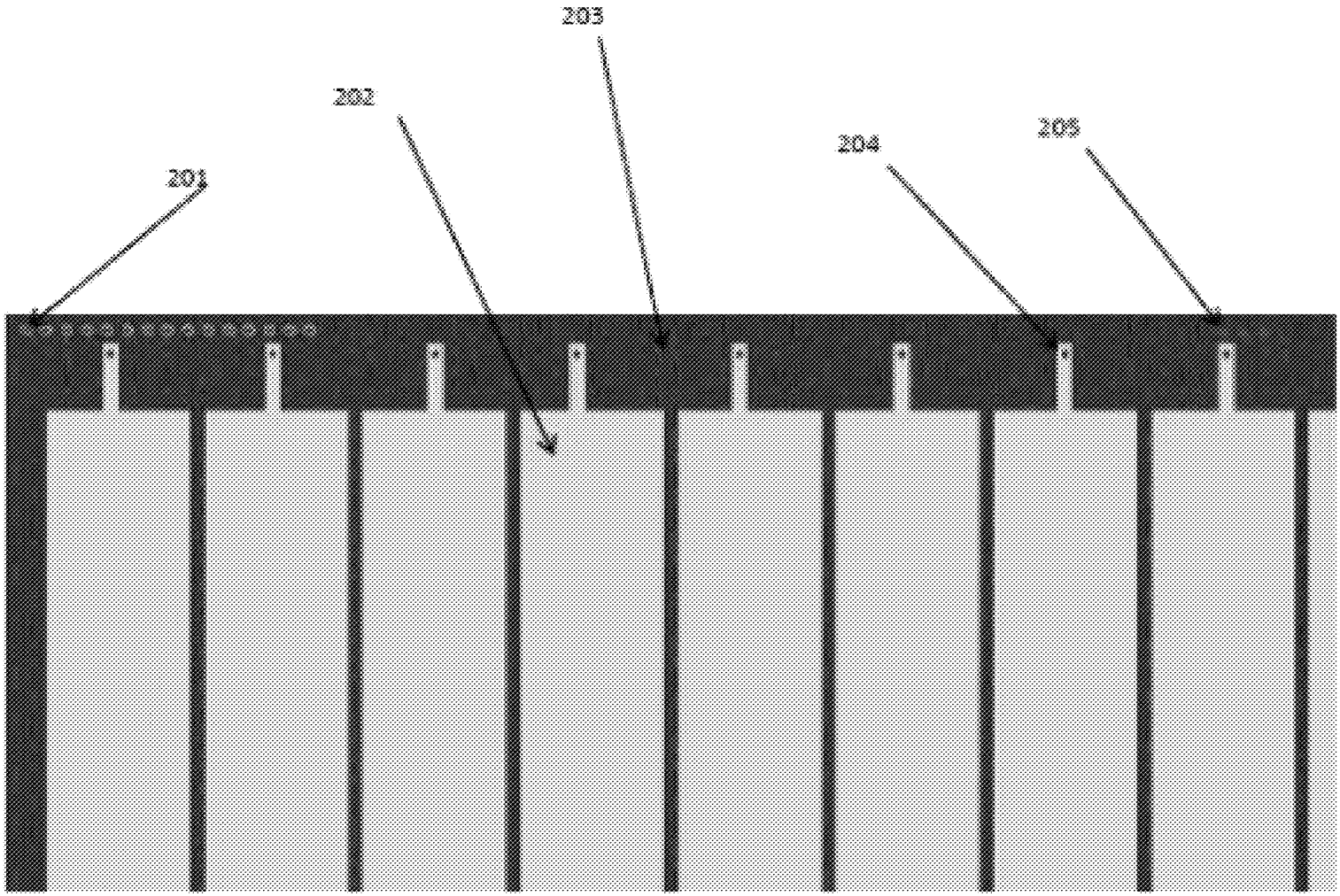

FIG. 2 shows a close up of the front left side of the target with the graphic B27 target removed. The front side of the first insulator (in this embodiment sheet of cardboard) 203 has multiple strips of conductors (in this embodiment strips of aluminum foil) 202 that will be used to sense a bullets position based on activated column sensor. The electronic sensors for the columns are picked up by spring loaded pins 204 located at the top of each column. The row sensors are located on the back side of the first sheet of cardboard and are orientated 90 degrees from the front columns. The pins 201 located at the top left make contact with each individual row via a hole bored through the first sheet of cardboard. There is a power grid located in the center of the target (in this embodiment a solid sheet of aluminum foil) used to power all of the sensors and is connected to the power circuit via 3 pins 205 located in the center of the target that extend through holes in both the first and second sheet of cardboard.

Figure 3:
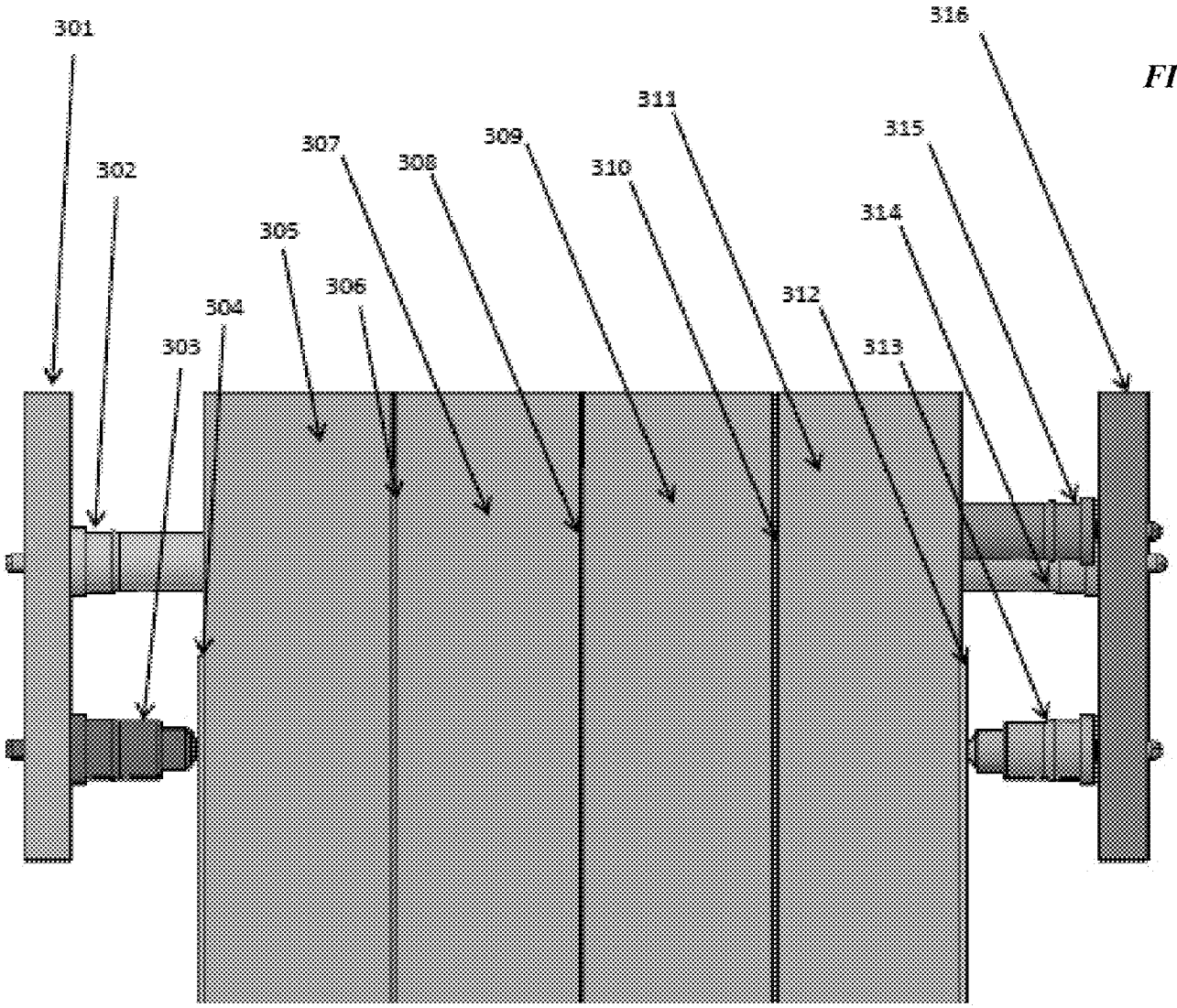

FIG. 3 shows a left side rendering of what the target system would look like with the spring loaded pins mounted into a circuit board on the target holder. The current embodiment of the target contains conductive foil/ink columns 312 on the front, conductive foil/ink rows 310 on the back of the $1^{st}$ sheet of cardboard 311. Bonded to that is a $2^{nd}$ insulating layer 309. Then a conductive foil/ink power grid layer 308 on the front of the $3^{rd}$ sheet of insulating layer 307. Lastly on the $4^{th}$ insulating layer 305 contains a right diagonal layer of conductive foil/ink 306 on the front and a left diagonal layer of conductive foil/ink 304 on the back. This creates a short circuit target that can use standard TTL logic to detect where a bullet hit the target. All of the sense lines for the columns, rows, right and left diagonal conductive foil/ink sensors have a pull down resistor to ground and are tied into a digital latch or FIFO input as well that will go high once the conductive bullet projectile makes contact with the power grid (comprised of a single continuous sheet of aluminum foil/conductive ink) which is power to 3.3 vdc or +5 vdc (also known as vcc). The pins 313 on the front circuit board 316 that make contact with the front column sensors as well as the pins 315 that passes through the front sheet of cardboard 311 and connect with the row layer 310 behind it. The power pins 314 that connect with the power grid layer 308 pass through both the first 311 and second 309 layers of cardboard. On the back side of the target the circuit board 301 left diagonal sensors pins 303 connect with the left diagonal sensor and the right diagonal sensors connect to the back circuit board via the right diagonal sensor pins 302.

As the bullet passes through the layers of cardboard from the front it will generate the following sequences of events. First the impacted column and row will go high once the bullet tip hits the power grid center layer and get latched into the high speed latch and or FIFO. Next when the bullet makes contact with the left and right diagonal sensors it will already be electrically hot or at vcc potential because it will still be in contact with the center power grid. That will cause the left and right diagonal sensors latch or FIFO inputs to go high. The data will be capture by a high speed digital acquisition system and processed locally on an embedded computer or transmitted back to the shooters station via wireless WIFI/cellular technology or hard wired Ethernet lines. The impact/round penetration location will be displayed on the shooter's cellphone or computer. More layers could be added to increase resolution but the entire target width must stay below the length of the shorted bullet. Otherwise a short may not occur across all of the sensors.

In another embodiment the power grid and one insulator can be removed where each successive sensor would be tied to ground and vcc alternately with a sense resistor. For example Columns would be tied to ground, rows would be tied to vcc, right diagonal tied to ground and left diagonal tied to vcc all using a 5 k ohm sensing resistor. But because when the bullet shorts them together they will be at a potential of approximately vcc/2 and an analog comparator would be required to sense them therefore requiring significantly larger circuit board need to support all of the analog components verses one large digital FPGA. Although the invention is described in terms of a specific embodiment, it will be readily apparent to those skilled in the art that various modifications, rearrangements and substitutions can be made without departing from the spirit of this invention.

Figure 4:
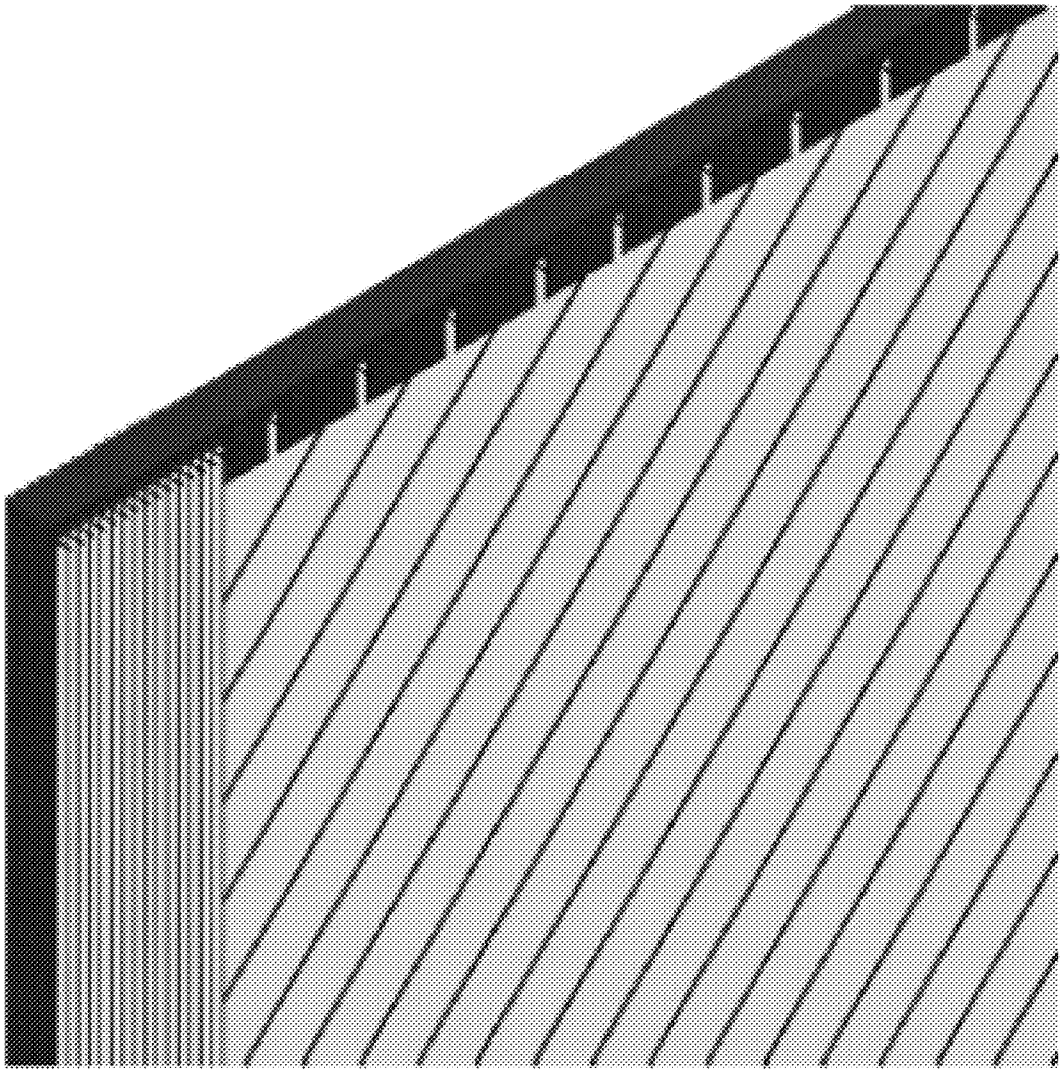

FIG. 4 Shows the back side of the target with spring loaded pins making contact with the diagonal sensors.

Figure 5:
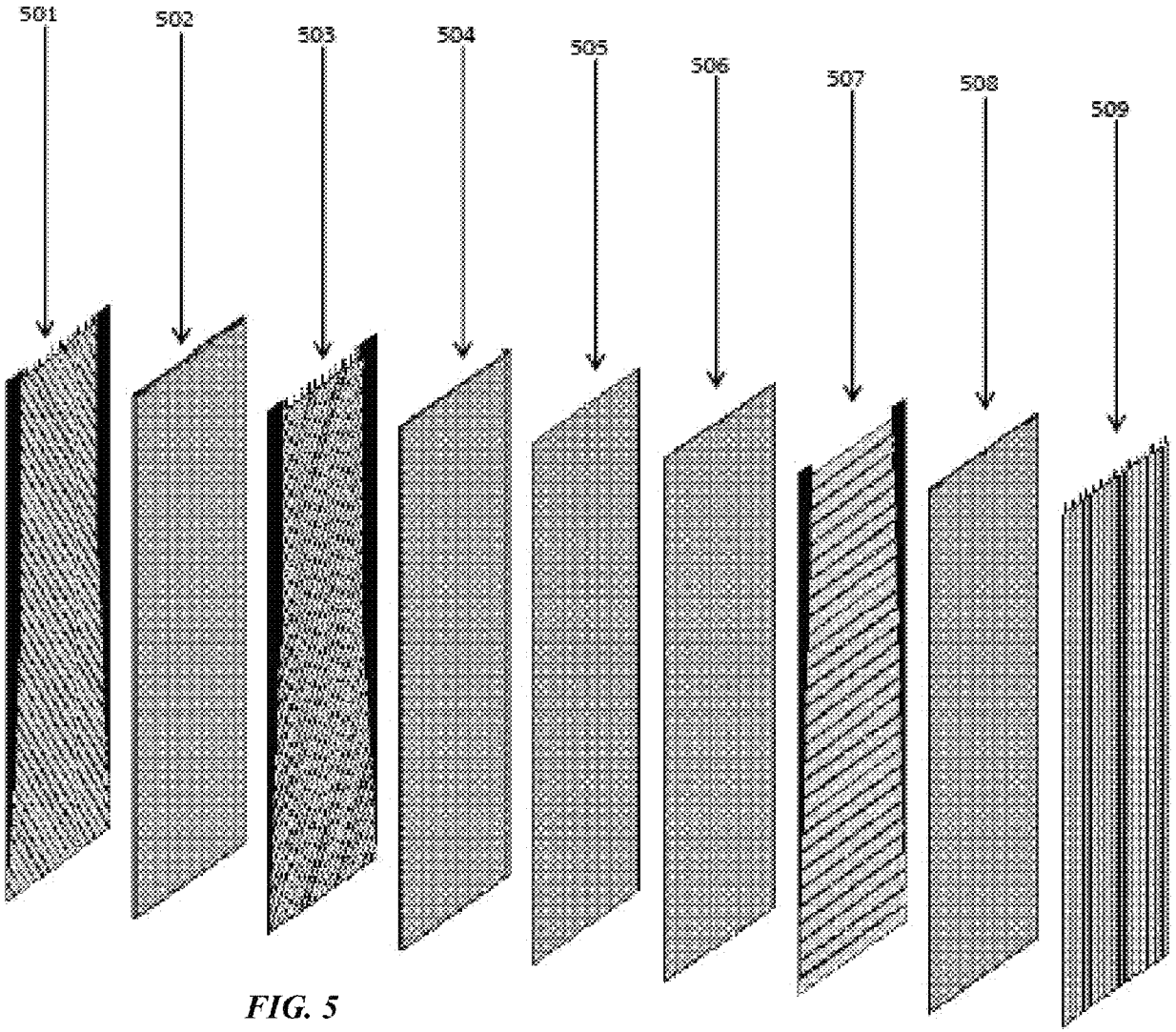

FIG. 5 Show an exploded diagram of the conductive foil/ink sensors and cardboard/chipboard/plastic insulators. From right to left, right being the front of the target and left being the back of the target. First we have the column sensors 509 bonded to the cardboard insulator 508 bonded to the row sensors 507 bonded to the cardboard insulator 506 bonded to the power grid 505 bonded to the cardboard insulator 504 bonded to the right diagonal sensors 503 bonded to the cardboard insulator 502 bonded to the left diagonal sensors 501.

Figure 6:
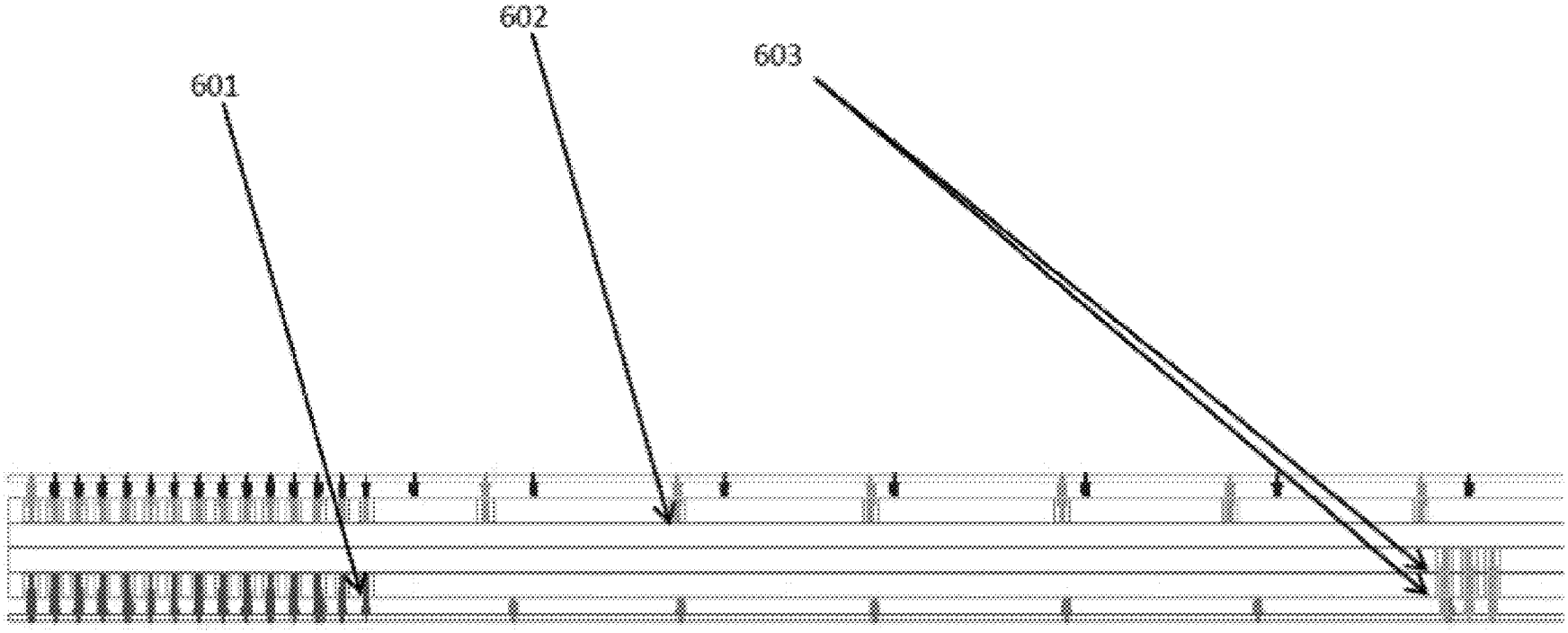

FIG. 6 Shows a transparent close up top view of the current embodiment of the target. The row contact pins on the top pass through holes drilled in the first cardboard sheet 601 to allow the spring loaded pins to make contact with the row sensors. The power grid pins pass through 2 cardboard sheets 603 so that the spring loaded power pins can make contact with the center power grid layer. The right diagonal sensor pins pass through holes drilled into the last cardboard sheet 602 to allow the spring loaded pins to make contact with the right diagonal sensors.

Figure 7:
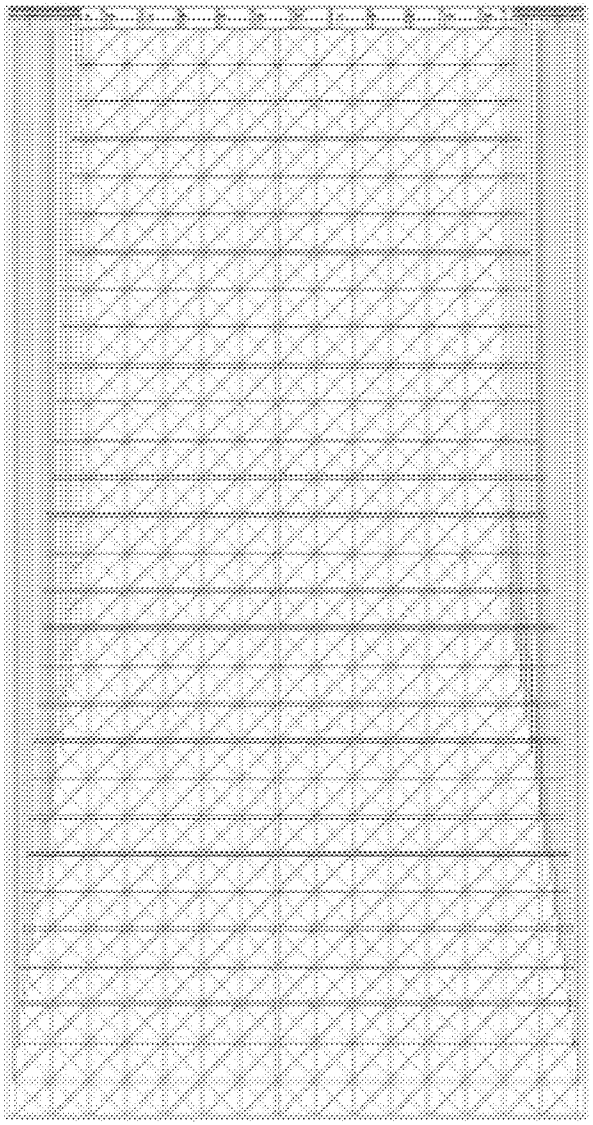

FIG. 7 Show a wire frame drawing of the front of the target. As you can see the spacing is designed so that they all converge at each intersection this allows for very accurate sensing if a bullet strikes between multiple sensors on the same layer because both sensors will fire and the gap exact location is known. For example an exact location of impact can be determined if a bullet were to pass through the gap at the intersection of all 4 conductive layers.

Figure 8:
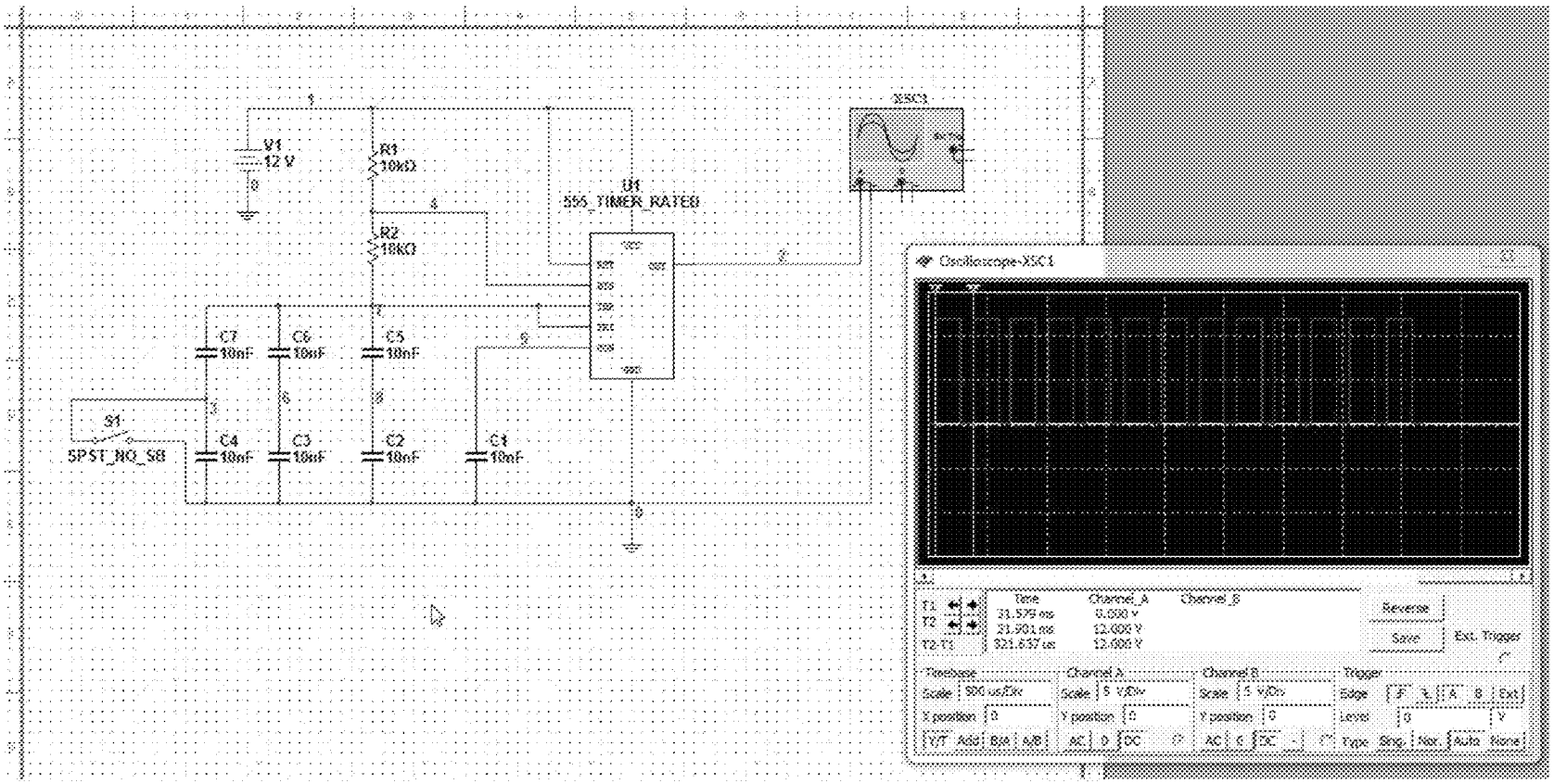

If you think about it a target of this type with foil laminated on both sides of an insulator should produce a capacitor. Therefore with a bullet disturbing the capacitance a circuit could be designed to capitalize on that fact. FIG. 8 shows a capacitive coupled simulation of the same target using the change in capacitance as the when the bullet shorts out 2 of the plates. By passing either commercial capacitors across each of the columns in a daisy chain fashion or by placing a foil strip that is shorted to all of the sensors such that it would product a different capacitance determined by the distance of the single sense wire on each set of sensors. For example if a foil strip was place across the top of the target on front and along the side vertically on the back and have only one spring loaded pin on the upper left hand corner for the front foil and one for the back foil. The impact location could be determined by using a capacitive controller oscillator for each back of sensors (one for Rows and one for Columns) when the bullet would pass through and make contact with the center grid (which is now at 0 vdc or grounded) it would generate a unique signature frequency with each foil sensor due to the capacitance increasing as you move further away from the pickup point. In this simulation notice that the switch is open and the oscillator is clocking at 321 us.

Figure 9:
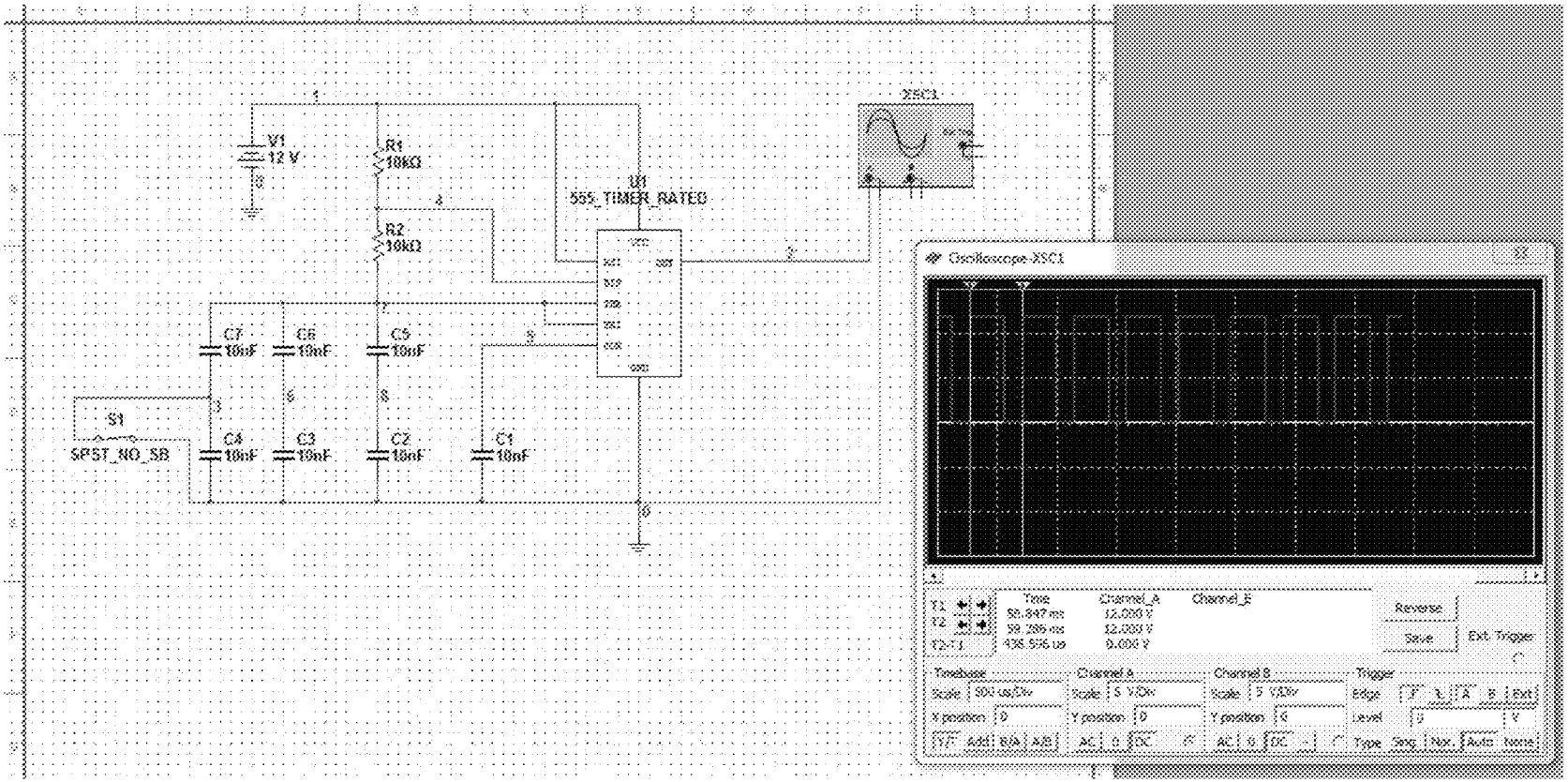

FIG. 9 Shows the switch thrown shorting out the first capacitor in the chain of capacitors modeling the above described design and the period has now shifted to 438 us. As each capacitor is shorted out a unique frequency is generated that can he used to determine which sensor was hit.

Figure 10:
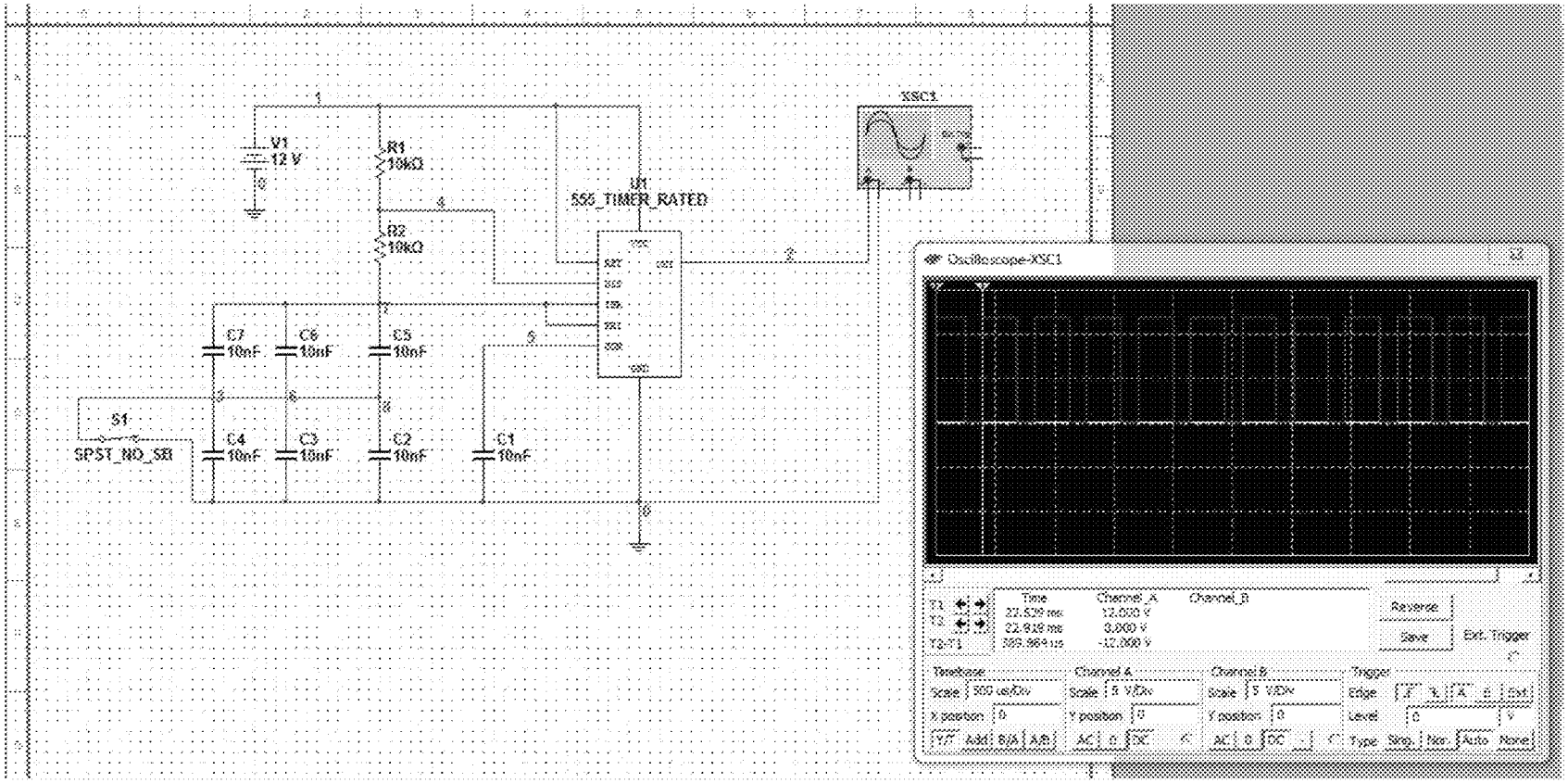

FIG. 10 Shows a different capacitor shorted out which represents the conductive bullet passing through. With this method of acquiring only a single sense wire is need for each of the 4 conductive foil/ink sensor grids. One can change the implementation of this method and not deviate from the core essence of this invention.

The invention claimed is:

1. A method for determining and retrieving positional information, comprising:

locating a plurality of first conductive elements on a surface and a plurality of second conductive elements on said surface to form a first grid having a first plurality of intersections, electrically isolating the plurality of first conductive elements from the plurality of second conductive elements;

coupling a second grid to the surface and electrically isolating the second grid from the plurality of first conductive elements and the plurality of second conductive elements, the second grid comprising of a plurality of third conductive elements on a surface and a plurality of fourth conductive elements on said surface to form a second grid having a second plurality of intersections, electrically isolating the plurality of third conductive elements from the plurality of forth conductive elements;

the second grid comprising a plurality of third conductive elements intersecting each other at a plurality of nodes, the plurality of nodes aligned with the plurality of intersections;

penetrating the surface with a projectile;

electronically determining a first location of a first penetration of the surface with the projectile based on a first change in a first electrical measurement of the first conductive element and a second change in a second electrical measurement of the second conducting element; performing a plurality of third and fourth electrical measurements on a second plurality of locations of the second grid; and electronically determining location of impact.

2. The method of claim 1 wherein the first measurement, the second measurement, and the plurality of third measurements comprise measurements of least one of potential and current.

3. The method of claim 1 wherein the plurality of first conductive elements and the plurality of second conductive elements comprise conductive elements of a plurality of first grid conductive elements of the first grid, and further comprising determining a third location of penetration of the surface based on a fourth change in a fourth electrical measurement of a fourth conductive element of the plurality of first grid conductive elements and a fifth change in a fifth electrical measurement of a fifth conducting element of the plurality of first grid conductive elements.

4. The method of claim 1 further comprising: Indicating an accuracy or a lethality of the impact using one or more luminaries.

* * * * *